US005293845A

United States Patent [19]

Yamazaki et al.

[11] Patent Number: 5,293,845

[45] Date of Patent: Mar. 15, 1994

[54] CONTROL MECHANISM FOR ENGINE VALVE TIMING

[75] Inventors: Masami Yamazaki, Okazaki; Atsushi Watanabe, Toyota; Yukiharu Ichinose, Toyota; Tatsuo Iida, Toyota, all of Japan

[73] Assignee: Toyota Jidosha Kabushiki Kaisha, Aichi, Japan

[21] Appl. No.: 934,252

[22] Filed: Aug. 25, 1992

[30] Foreign Application Priority Data

| | | | |
|---|---|---|---|
| Sep. 2, 1991 | [JP] | Japan | 3-221889 |
| May 13, 1992 | [JP] | Japan | 4-120796 |
| May 13, 1992 | [JP] | Japan | 4-120797 |

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/1, 2, 160; 74/568 R, 567

[56] References Cited

U.S. PATENT DOCUMENTS

| | | | |
|---|---|---|---|
| 3,369,418 | 2/1968 | Young | 123/90.15 |
| 4,305,352 | 12/1981 | Oshima et al. | 123/90.31 |
| 4,716,862 | 1/1988 | Sauro | 123/901.5 |
| 4,955,330 | 9/1990 | Fabi et al. | 123/90.17 |
| 5,080,053 | 1/1992 | Parsons | 123/90.15 |
| 5,174,253 | 12/1992 | Yamazaki et al. | 123/90.17 |

FOREIGN PATENT DOCUMENTS

| | | | |
|---|---|---|---|
| 3929624 | 3/1991 | Fed. Rep. of Germany | 123/90.17 |
| 59-115414 | 7/1984 | Japan . | |
| 60-118313 | 8/1985 | Japan . | |
| 61-152980 | 12/1986 | Japan . | |
| 61-279713 | 12/1986 | Japan . | |
| 64-22807 | 2/1989 | Japan . | |
| WO90/04704 | 5/1990 | PCT Int'l Appl. . | |
| 2224093 | 4/1990 | United Kingdom | 123/90.17 |
| 2229248 | 9/1990 | United Kingdom | 123/90.17 |

*Primary Examiner*—E. Rollins Cross
*Assistant Examiner*—Weilun Lo
*Attorney, Agent, or Firm*—Oliff & Berridge

[57] ABSTRACT

A control mechanism for shifting the rotational phase transmitted from an engine, and for controlling the timing of the intake and exhaust valves. A first gear mechanism integrally rotates with respect to a timing pulley, and has a set of inner peripheral gear teeth. A second gear mechanism integrally rotates with respect to a camshaft, and has a set of outer peripheral gear teeth. The number of gear teeth of the first gear mechanism is greater than that of the second gear mechanism. This gear ratio generates a rotational phase shift of the timing pulley with respect to the camshaft, in order to vary the opening and closing timing of the intake and exhaust valves. A drive means drives the first gear mechanism in order to vary the phase shift and to control the opening and closing timing of the intake and exhaust valves in accordance with the operating state of the engine.

18 Claims, 10 Drawing Sheets

CONTROL MECHANISM FOR ENGINE VALVE TIMING

BACKGROUND OF THE INVENTION

1. Field of the Invention

The present invention generally relates to a control mechanism for an engine valve. More particularly, this invention pertains to an improved mechanism for controlling the timing of the intake and exhaust valves in an internal combustion engine.

2. Related Art

An internal combustion engine in a vehicle, generally requires a control mechanism for controlling the timing for the opening and closing of the intake and exhaust valves, in relation to the operation state of the engine. The control mechanism conveys and regulates the rotational phase of a camshaft with respect to a crank shaft.

A control mechanism for engine valve timing of this type is disclosed in the Japanese Unexamined Patent Publication No. 61-279713. This Publication describes a timing pulley 101 which is operatively connected to the engine, and which is disposed at one end of a camshaft 100. A helical ring gear 102 interconnects the camshaft 100 and the timing pulley 101. At least one set of teeth is formed on the inner and outer peripheries of the ring gear 102. When the ring gear 102 moves along the axial direction, it rotates in synchrony with the camshaft 100. Pressurized oil is supplied through oil passages in the camshaft 100, by means of a hydraulic pump within the timing pulley 101. One end section of the ring gear 102 is supported by a spring 103 for withstanding the oil pressure.

When oil pressure is applied on the ring gear 102, the ring gear 102 is caused to move in the axial direction and to overcome the resistive force of the spring 103. Torsion against the timing pulley 101 is generated on the camshaft 100, so that a phase in the rotational direction (the rotational phase), between the camshaft 100 and the timing pulley 101 is changed, for regulating the opening and closing timing of the intake and exhaust valves. The ring gear 102 is moved along the axial direction of the camshaft 100 in order to vary the value of the phase shift. When it is desired to increase the rotational phase, it would be necessary to lengthen the stroke of the ring gear 102, or to increase the teeth angle of the ring gear 102.

When it is desired to lengthen the stroke of the ring gear 102, the size of the control mechanism is increased along the axial direction. Therefore, the mounting of the control mechanism in a vehicle becomes more difficult. When the torsion angle of the teeth is increased, the operative resistance of the ring gear 102 is increased. Therefore, in order to increase the hydraulic pressure, the operative response time of the mechanism should be decreased.

SUMMARY OF THE INVENTION

It is therefore an object of the present invention to provide a new control mechanism for controlling the valve timing in an internal combustion engine. The mechanism permits the regulation of the rotational phase without moving along the axial direction of the camshaft. As a result, the overall size of the mechanism is reduced.

BRIEF DESCRIPTION OF THE DRAWINGS

FIG. 4(*b*) is a cross-sectional view illustrating the inner rotor being rotated by a predetermined angle corresponding to one half of a tooth of the inner rotor;

FIG. 11(*b*) shows the timing pulley rotated 180 degrees from its position shown in FIG. 10;

DETAILED DESCRIPTION OF THE PREFERRED EMBODIMENT

A first preferred embodiment of a control mechanism for valve timing in an internal combustion engine, will now be described referring to FIGS. 1 through 7.

Figure 2:
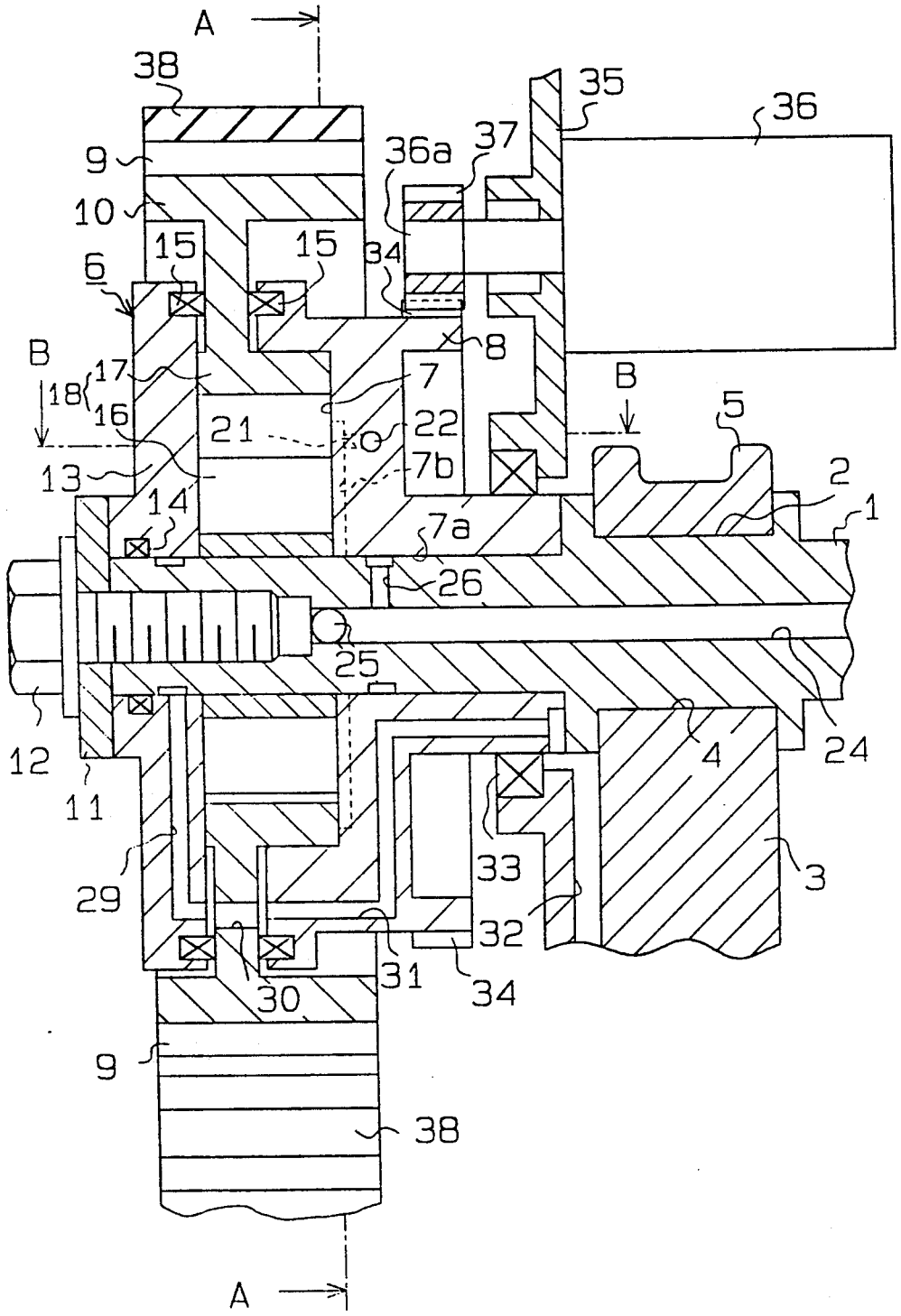
FIG. 2 is a cross-sectional view illustrating the valve timing mechanism.

FIG. 2 is a cross sectional view illustrating the mechanism for controlling the valve timing in the engine. A journal 2 of a camshaft 1 actuates an intake valve and an exhaust valve (not shown), and is rotatably supported between a cylinder head 3 and a bearing cap 5. A timing pulley assembly 6 is secured to the distal end of the camshaft 1.

The detailed description of the timing pulley assembly 6 will now be described. A casing 8 is rotatably supported by the camshaft 1. The casing 8 has an annular side wall. A holding recess 7 having a generally circular cross section, and an eccentric center with respect to that of the casing 8 is formed in the side wall. A timing pulley 10 is rotatably formed within the recess 7, and has a plurality of external peripheral gear teeth 9. A cover 13 is secured to the distal end of the camshaft 1 by means of a bolt 12 and a cap 11. A seal member 14 seals the cover 13 and the camshaft 1, and a seal member 15 seals the cover 13, the timing pulley 10 and the casing 8.

Figure 1:
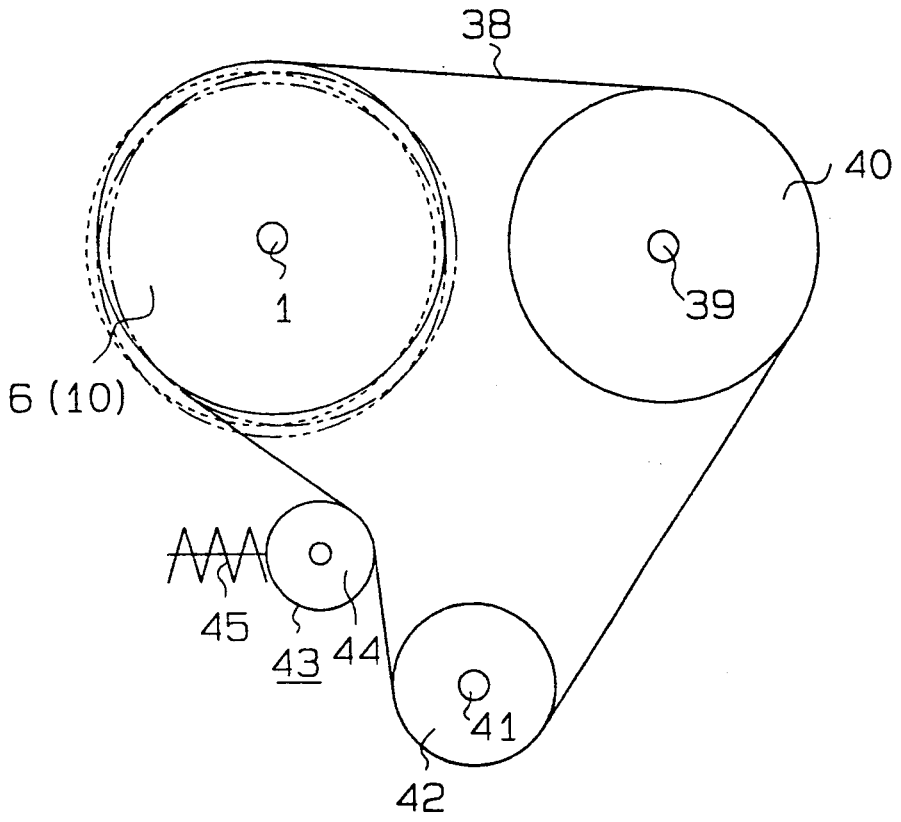
FIG. 1 is a schematic view illustrating a power passage from the engine to the cam shaft of the first embodiment.
Figure 3:
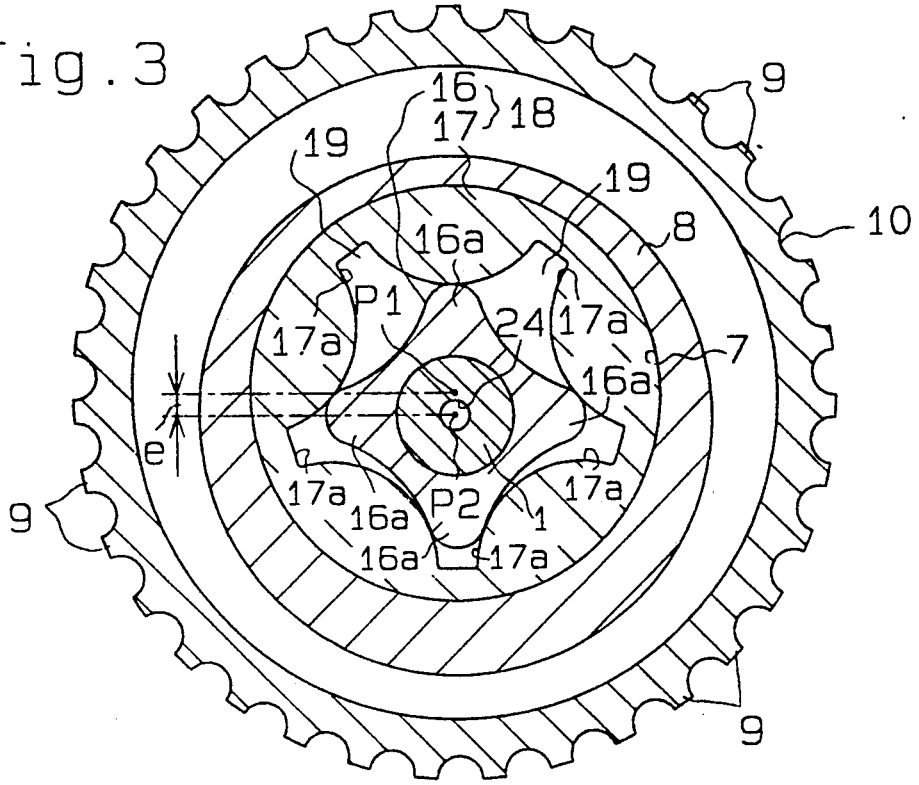
FIG. 3 is a cross-sectional view taken along a line A—A of FIG. 2.
Figure 4:
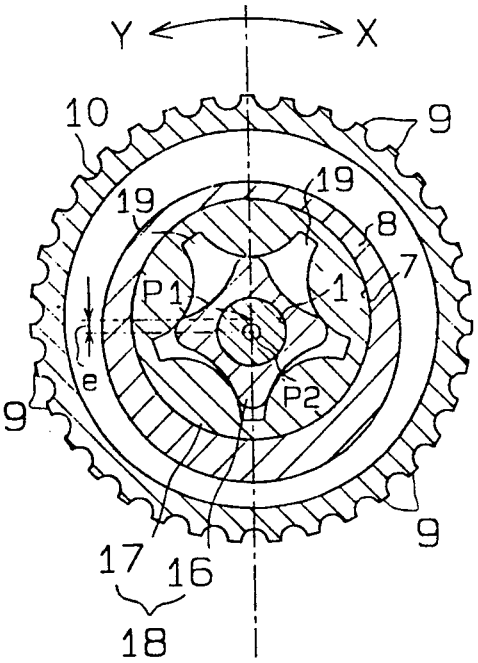
FIG. 4(*a*) is a cross-sectional view illustrating an inner rotor and an outer rotor at the original positions, respectively.
Figure 4:
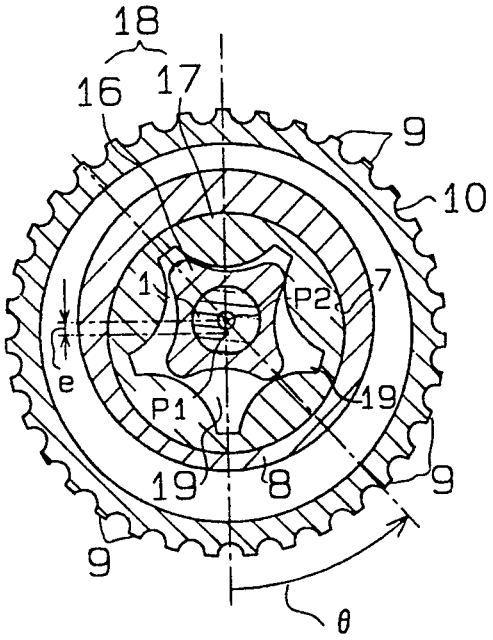

FIGS. 3, 4 (A) and 4 (B) illustrate cross sectional views of FIG. 1, taken along line A—A. The casing 8 is concentrically formed with respect to the camshaft 1, and have a common geometrical center P2. The holding recess 7 has a geometrical center P1 which is eccentrically disposed with respect to the center P2. Therefore, when the casing 8 is rotated, the center P1 of the holding recess 7 orbits around the center P2 of the camshaft 1, along a predetermined, generally circular orbit.

An inner rotor or trochoid gear 16 has four outwardly protruding gear teeth 16*a* around the outer periphery of the camshaft 1. The inner rotor 16 is rotatable within the holding recess 7. An outer rotor or trochoid gear 17 has five innerwardly protruding gear teeth 17*a*, which engage the gear teeth 16*a* of the inner rotor 16. The outer rotor 17 is provided in the center section of the timing pulley 10, within the holding recess 7.

Each gear tooth of the outer rotor 17 has an arcuate shape. The shape of the each gear tooth of the inner rotor 16 is determined by an envelop of consecutive arc. The center of each arc has its center coinciding with the trochoid line. As the sliding speed of the teeth surfaces between the inner rotor 16 and the outer rotor 17 becomes smaller, friction between the rotors 16 and 17 is significantly reduced. The inner rotor 16 has its geometrical center coincide with the center P2 of the cam shaft 1. The outer rotor 17 has its geometrical center coincide with the center P1 of the holding recess 7.

When the inner rotor 16 and the outer rotor 17 engage each other, they are eccentrically disposed by a predetermined, generally constant eccentricity distance e. Consequently, the center P1 of the outer rotor 17 moves around the center P2 of the inner rotor 16, along a predetermined circular orbit. The rotational phase of the inner rotor 16 and the outer rotor 17 varies in correspondence with the rotational phase of the camshaft 1 and the timing pulley 10.

The inner and outer rotors 16 and 17 form a trochoid gear mechanism or a gear pump 18. A chamber 19 is formed between the inner rotor 16 and the outer rotor 17, and is filled with lubricating oil which is pumped by the gear pump 18.

Figure 5:
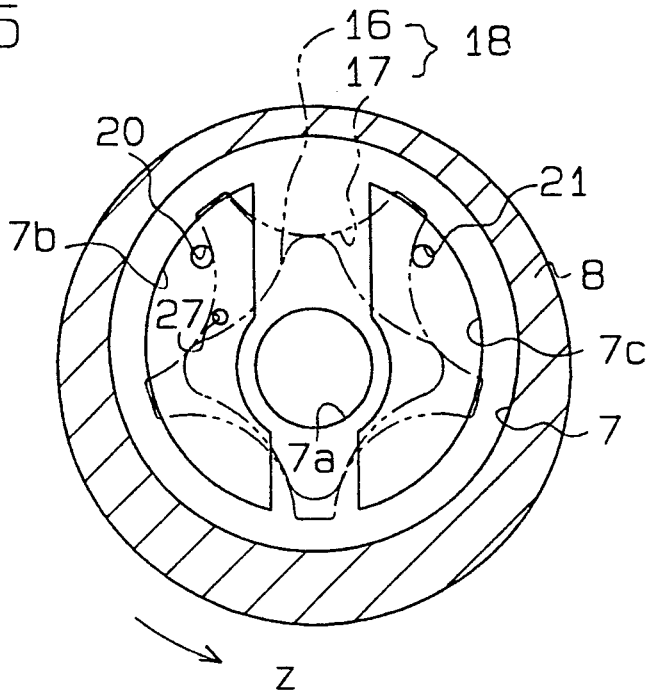
FIG. 5 is a cross-sectional view taken along a line A—A in FIG. 1.

FIG. 5 is a cross sectional view of the casing 8 of FIG. 2, taken along line A—A. FIG. 5 illustrates an opening 7*a* through which the camshaft 1 is inserted. The opening 7*a* is formed in the wall of the holding recess 7. An inlet groove 7*b* and an outlet groove 7*c* are symmetrically formed with respect to the opening 7*a*. Each one of the grooves 7*b* and 7*c* has an inlet port 20 and an outlet port 21, for allowing the lubricating oil to pass through the timing pulley 10, and for causing the lubricating oil to be drawn, or expelled, via the inlet port 20 and the outlet port 21, in accordance with the rotational direction of the outer rotor 17.

Figure 6:
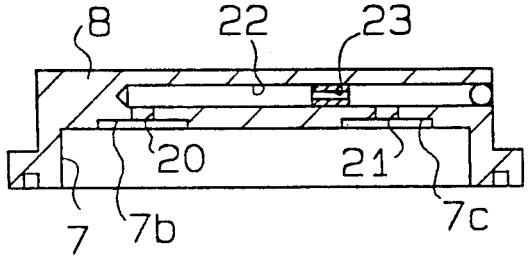
FIG. 6 is a cross-sectional view taken along a line B—B in FIG. 1.

FIG. 6 is a cross sectional view of the casing 8 of FIG. 2, taken along line B—B. A circulation oil passage, for circulating the lubricating oil from the outlet port 21 to the inlet port 20 is formed between the inlet port 20 and the outlet port 21. A throttle 23, for regulating the flow of the lubricating oil, is formed at a predetermined location along the oil passage 22.

The outer rotor 17 causes the inner rotor 16 to rotate in the same rotational direction as the outer rotor 17. The relative rotation of both rotors 16 and 17 causes misalignment of the gear teeth engagement between the inner rotor 16 and the outer rotor 17. The lubricating oil in the chamber 19 is pressurized by this misalignment. The pressurized lubricating oil is circulated from the outlet port 21 to the inlet port 20 through the passage 22.

The trochoid gears provide for the circulation of the lubricating oil. Furthermore, in this embodiment, a mechanism for filling and maintaining the required amount of lubricating oil is provided, in order to replenish the oil leaked from the chamber 19 and the holding recess 7. A more detailed description will now be given preferring to FIG. 2.

Figure 7:
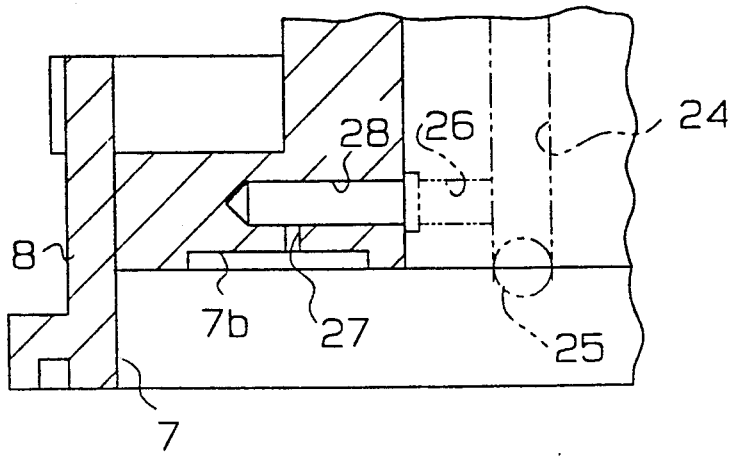
FIG. 7 is a partial cross-section view illustrating a support port and a support oil passage of the casing.

A primary oil passage 24 is formed along the longitudinal direction of the camshaft 1. One end portion of the passage 24 is sealed by a ball 25. At least one secondary oil passage 26, for interconnecting the primary passage 24 and casing 8, is formed in the vicinity of the sealed end portion. A filling port 27, for filling the lubricating oil in the chamber 19, is formed in the groove 7*b* of the casing 8, as shown in FIGS. 5 and 7. A filling passage 28 is interconnected to the port 27, and is formed within the casing 8. The passage 28 is connected with the primary passage 24, via the secondary passage 26 of the camshaft 1. The chamber 19 receives the lubricating oil from the primary passage 24, via each one of the passages 26, 27 and 28.

The lubricating oil is supplied from a hydraulic circuit including an oil pan, an oil pump and an oil filter (not illustrated), to the passage 24. Drain passages 29 through 32 are interconnected and are respectively provided in the cover 13, the timing pulley 10, the casing 8 and the cylinder head 3, in order to collect the oil which may be leaking from the gear pump 18, the chamber 19 and the holding recess 7. A seal member 33 is provided between the casing 8 and the cylinder head 3, in order to prevent the lubricating oil from leaking from the passage 31 of the casing 8 to the passage 32 of the cylinder head 3. The passage 32 of the cylinder head 3 is connected to the oil pan (not illustrated).

Therefore, the lubricating oil is filled into the chamber 19 of the gear pump 18, through the secondary passage 26, the passage 28 and the port 27, via the primary passage, which receives the oil from the hydraulic circuit, in relation to operating state of the internal combustion engine. The oil that leaks from the chamber 19 and the holding recess 7 is collected and drained into the oil pan in the hydraulic circuit, through each one of the passages 29 through 32.

In this embodiment, the control mechanism is provided to vary the rotational phase of the camshaft 1 and the timing pulley 10, through the camshaft 1. The operation of the control mechanism will now be described in more detail.

The external gear teeth 34 protrude outwardly and are formed in the outer peripheral surface of the casing 8. A head cover 35 covers the cylinder head 3. An electric motor 36 is securely supported by the cover 35. The motor 36 is caused to rotate at a calculated adjustable speed in the clockwise direction X, or in the counter-clockwise direction Y, for adjusting the valve timing.

Figure 8:
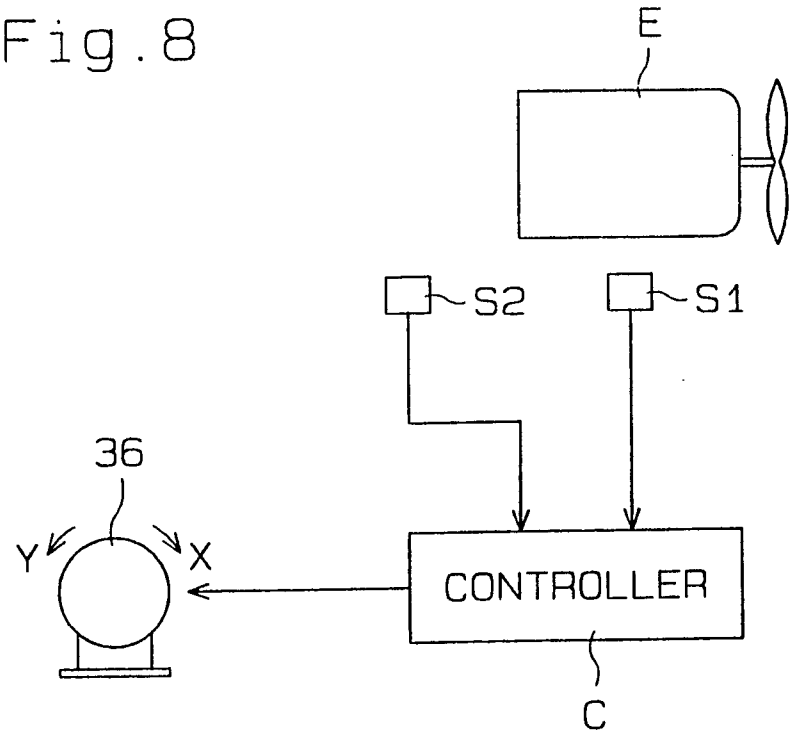
FIG. 8 is a block diagram of a control circuit for actuating a motor.

The adjustable speed of the motor 36 is determined by a controller C which receives various data transmitted from a plurality of sensors (FIG. 8). For illustration purposes, these sensors include a sensor S1 for monitoring the engine rotation, a sensor S2 for monitoring the throttle angle, and various sensors for monitoring the operating state of the engine E.

An output shaft 36*a* of the motor 36 protrudes through the cover 35, toward the casing 8. A pinion gear 37 engages the gear teeth 34 of the casing 8, and is formed around the shaft 36*a*. The motor rotates integrally with the casing 8, via the pinion gear 37 and the gear teeth 34. The outer rotor 17 has its center P1 rotate around the center P2 of the inner rotor 16, along the predetermined circular orbit. Therefore, the timing pulley 10 is capable of moving by a predetermined distance.

The outer rotor 17 has five teeth, and integrally moves with the timing pulley 10. The inner rotor 16 has four teeth and integrally moves with the camshaft 1. The outer rotor 17 causes the inner rotor 16 to rotate at the gear ratio of five to four (5:4). Therefore, the rotational phase of the outer rotor 17 to the inner rotor 16 continuously varies. When the timing pulley 10 makes a complete revolution, the camshaft 1 rotates by a distance that is less than the revolution of the inner rotor 16, by one sixteenth of a teeth angle of the inner rotor 16. This causes the rotational phase to shift between the timing pulley 10 and the camshaft 1.

The ratio of the number of teeth in a crank pulley 42 to the number of teeth in the timing pulley 10 disposed at the right bank, is predetermined, in order to cancel out the phase difference caused by the gear ratio of the inner rotor 16 to the outer rotor 17. Therefore, the usual phase shifting of a crank shaft 41 to the camshaft 1 does not occur. The ratio of the teeth number of the timing pulley 10 to a timing pulley 40 disposed at the left bank is predetermined by the gear ratio five to four (5:4), in order to cancel out the rotational phase shifting of the timing pulley 10 to the camshaft 1. Consequently, the rotational speed transmitted to both pulleys 10 and 40 is adjusted.

In this embodiment, the timing pulley 10 is eccentrically arranged with respect to the center P2 of the camshaft 1. Therefore, as illustrated in FIG. 1, the timing pulley 10 rotates along a path shown in a solid line and broken lines. The tension of a timing belt 38 is correspondingly variable. A belt tensioner 43 is provided to cause tension variation of the belt 38, as a result of the variation of the geometrical center of the timing pulley 10. The tensioner 43 includes a tension idler 44 which engages the belt 38, and a spring 45 which presses the idler 44 against the belt 38.

The operation of a regulator for the valve control mechanism in an internal combustion engine will now be described.

As illustrated in FIG. 4 (A), the eccentric relationship of the outer rotor 17 with respect to the inner rotor 16 is fixed. In other words, the rotational phase shift of the timing pulley 10 to the camshaft 1 is constant. The change in rotational phase shift of the timing pulley 10 to the camshaft 1 will now be described.

When the casing 8 is rotated clockwise, 180 degrees, in the direction of the arrow X, the engaging point of the outer rotor 17 with the inner rotor 16 is also shifted accordingly, with respect to the casing 8. The inner rotor 16 rotates a little as a result of the difference of the teeth number between the rotors 17 and 16 (FIG. 4A). The casing 8 is moved only 180 degrees in this case, the inner rotor 16 is rotated by the predetermined angle ($\theta$), such as the angle of one half of one tooth of the outer rotor 17 (in this example, the angle is 36°). The timing pulley also rotates in the clockwise direction X. Consequently, the phase of the inner rotor 16 is shifted by one half of one tooth, as the outer rotor 17 integrally rotates with the timing pulley 10.

Therefore, torque is generated on the camshaft 1, so that the rotational phase of the camshaft 1 to the timing pulley 10 is shifted. Therefore, the operational timing for the inlet valve and the outlet valve varies. In other words, the valve timing is controlled.

The rotational center of the timing pulley 10 is generally located at about the center of the orbit of rotation of the center P1 of the holding recess 7. When the center P1 of the holding recess 7 is moved about by the predetermined amount along the circular orbit, the center of the timing pulley 10 is also moved accordingly. The belt tensioner 43 fills the tension variation of the timing belt 38 caused by the movement of the timing pulley 10. Therefore, the rotational speed to be inputted to each one of the timing pulleys 10 and 40 via the crank pulley 42 remains substantially constant.

In this embodiment, the casing 8 which governs the eccentric relationship of the outer rotor 17 to the inner rotor 16, moves around the center P2 of the camshaft 1, when the casing 8 is driven by the motor 36. Therefore, the center P1 of the holding recess 7 moves around the center P2 of the camshaft 1 along the predetermined circular orbit. Since the outer rotor 17 is retained within the holding recess 7, the center P1 moves within the outer periphery of the holding recess 7.

The engagement point of the gear teeth of the outer rotor 17 and those of the inner rotor 16 also shifts. The outer rotor 17 is rotated by the predetermined angle ($\theta$), in accordance with the movement of the outer periphery of the holding recess 7. The rotational phase of the inner rotor 16 to the outer rotor 17 is shifted by one tooth difference caused by the relation of the gear pump 18, every revolution.

The rotational phase relationship of both rotors 16 and 17 could be varied by moving the casing 8 in the clockwise direction X,or in the counter-clockwise direction Y, by actuating the motor 36 accordingly. Therefore, the phase shift between the inner and outer rotors is allowed to vary selectively,in order to control the valve timing. The phase shift is regulated by the motor 36. The motor shaft 36*a* is rotated by a desirable rotational angle, in order to provide the appropriate phase shift corresponding to the rotational angle of the motor. Consequently, the phase shift of the valve timing can be continuously regulated. Compared to conventional hydraulic systems, the response time for regulating the valve timing, which is controlled by the motor 36, is significantly improved.

The ring gear employed in a conventional art will no longer be needed. The ring gear is now replaced by the trochoid gear mechanism 18 including the inner rotor 16 that is integrally rotatable with the camshaft 1, and the outer rotor 17 that is integrally rotatable with the timing pulley 10. When the rotational phase of the camshaft 1 to the timing pulley 10 is to be changed, the center P1 of the outer rotor 17 is rotated around the center P2 of the inner rotor 16, by actuating the motor 36. In other words, the engaging point of the teeth of both the camshaft 1 and the timing pulley 10 is shifted along the outer periphery of the camshaft 1 in order to shift the rotational phase of the camshaft 1 to the timing pulley 10.

The mechanism for controlling the valve timing according to the present invention is different from conventional control devices where the ring gear is moved along the axial direction of the camshaft, in order to shift the rotational phase of the camshaft to the timing pulley. Therefore, the size of the control mechanism of the valve timing is reduced, as it is no longer necessary to move the control gear mechanism along the axial direction. It is now easier to mount the control mechanism in the vehicle. According to the present embodiment, the motor 36 is disposed in the inner side of the head cover 35, so as not to impede the installation of the control mechanism.

Furthermore, according to the this embodiment, the rotational angle of the casing 8 is only necessary to regulate the phase shift of the camshaft 1 to the timing pulley 10. There is no space limitation for rotating the casing 8 for increasing the rotational phase of the motor 36.

An essential portion of the valve timing control mechanism includes the trochoid gears. A significant torque is transmitted between the timing pulley 10 and the camshaft 1 through the trochoid gears, so that the probability of malfunction of the valve timing control mechanism is significantly reduced.

Since the inlet port 20, the outlet port 21 and the hydraulic circulation passage 22 are provided within the chamber 19 of the trochoid gears, the lubricating oil is circulated in accordance with the shifting of the chamber 19, as a relation to the operating state of the engine. The inlet port 20 and the outlet port 21 are arranged in accordance with the rotational direction of the outer rotor 17, so that the pressure of the lubricating oil in the chamber 19 does not undesirably increase.

The rotation of the camshaft 1 is usually accompanied by torque pulsation. The pulsation elements may cause noise generation between the outer rotor 17 and the inner rotor 16, when the gear teeth of both rotors 16 and 17 engage each other to transmit the torque. Thus, according to the present embodiment, the throttle 23 disposed in the passage 22 acts as a pulsation damper, in order to prevent the torque pulsation of the camshaft 1 under the generated pressure. Consequently, the noise caused by the teeth engagement is also minimized if not completely eliminated.

Furthermore, the inner rotor 16, which is disposed between the two chambers 19 of the inlet side and the outlet side, is securely attached to the camshaft 1 that acts as a dumper, for controlling the torque pulsation generated within the chambers 19. The trochoid gear mechanism 18 acts as a trochoid pump, and further acts as a damper, for buffering the torque pulsation of the camshaft 1. As a result, no additional damper mechanism is required, and the size and the manufacture cost of the valve timing control mechanism are significantly reduced.

Furthermore, the lubricating oil for the trochoid gear mechanism 18 is needed to be filled, only to maintain the predetermined level of the oil. The pressurization of the oil is not required. Accordingly, unlike the conventional ring gear which is generally provided to pressurize the lubricating oil, regulating circuits having various types of meters and sensors for controlling the internal pressure of the passage are not required.

Figure 9:
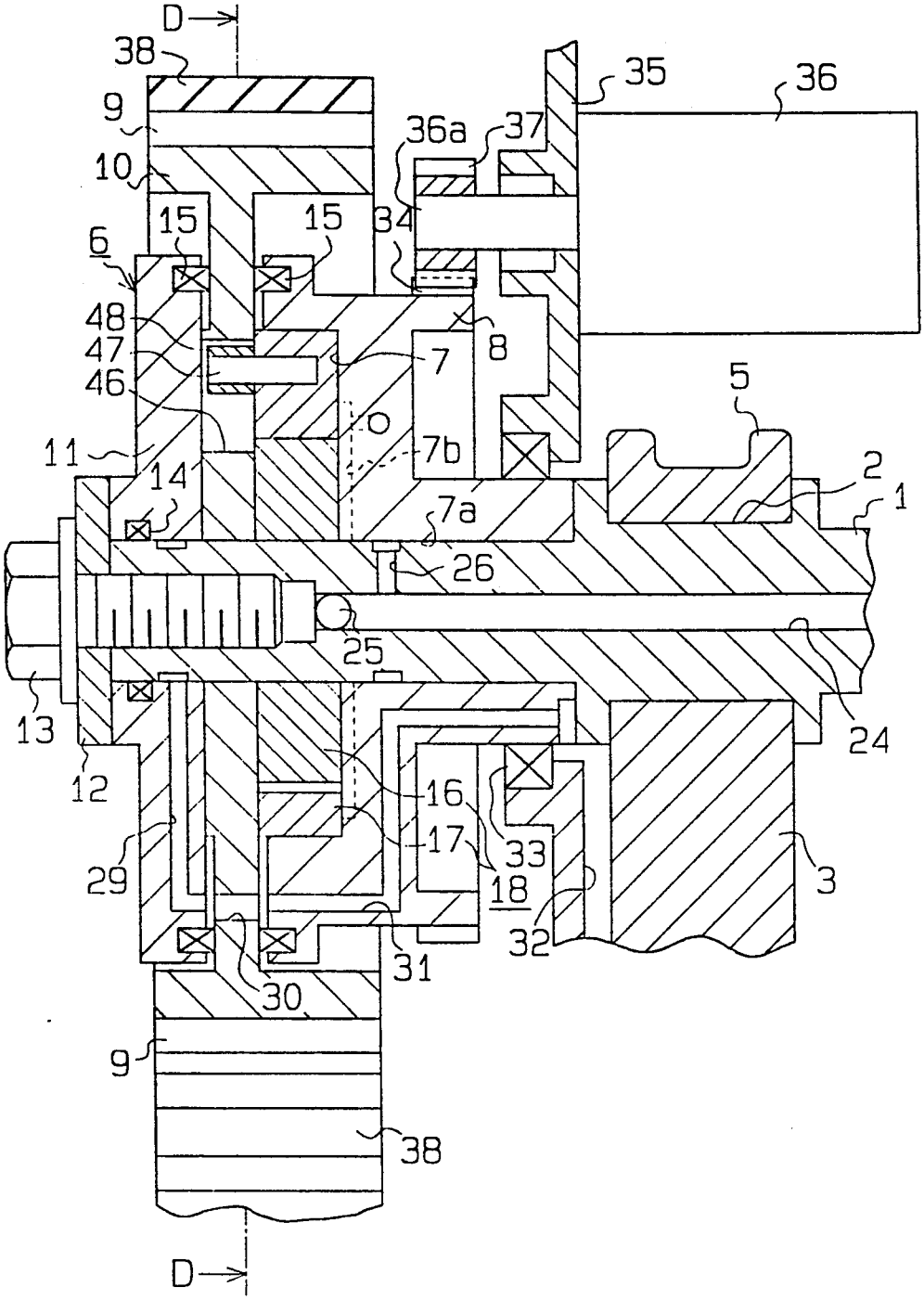
FIG. 9 is a cross-sectional view illustrating a valve timing mechanism of a second embodiment.
Figure 10:
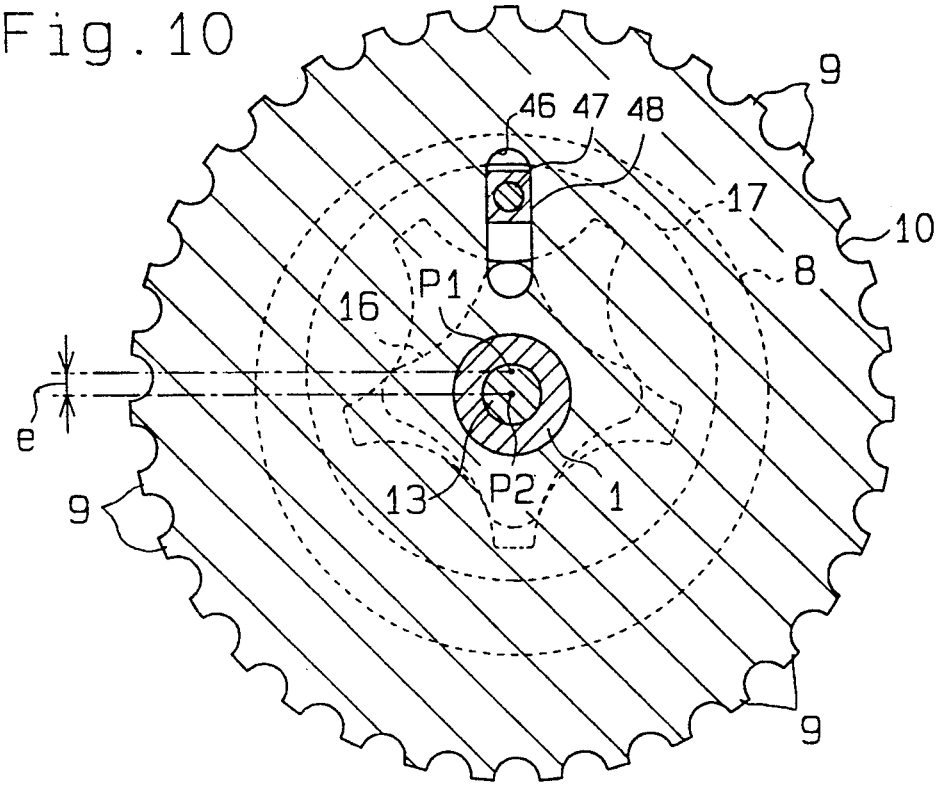
FIG. 10 is a cross-sectional view taken along a line D—D in FIG. 9.
Figure 11:
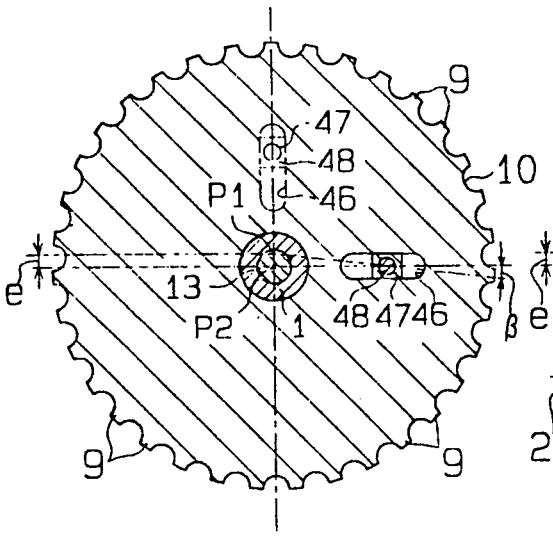
FIG. 11(*a*) shows the timing pulley rotated 90 degrees from its position shown in FIG. 10.
Figure 11:
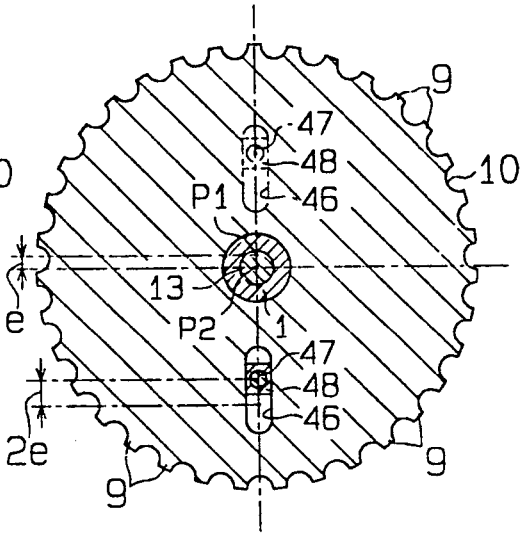

A second preferred embodiment where a mechanism for controlling valve timing in an internal combustion engine, according to the present invention, will now be described referring to FIGS. 9 through 11.

The timing pulley 10 and the outer rotor 17 are separately formed. The geometrical center of the timing pulley 10 coincides with the center P2 of the camshaft 1. An elongated opening 46 is formed in the central section of the timing pulley 10. A pin 47 is securely fastened to one of the side surfaces of the outer rotor 17. One end of the pin 47 is inserted into the elongated opening 46. A slider 48 is rotatably fastened to the end of the pin 47. The slider 48 is permitted to slide along the longitudinal direction of the elongated opening 46, and be guided by the pin 47.

The outer rotor 17, which is connected to, and is caused to rotate with the timing pulley 10, via the pin 47. The timing pulley 10 rotates around the center P2 of the camshaft 1 which is also the center of the timing pulley 10. The center P1 of the outer rotor 17 is eccentrically situated with respect to the center P2, by a predetermined amount e. The outer rotor 17 moves along a predetermined orbit around the inner rotor 16, and the center P1 rotates in a generally circular orbit around the center P2. When this circular movement is transmitted to the timing pulley 10, the rotational transmission from the crank shaft to the camshaft 1 is affected. The slider 48 is employed to solve the above-mentioned problem. Although the camshaft 1 rotates simultaneously with the timing pulley 10 and the outer rotor 17, for simplicity and explanation purposes, the movement of the slider 48 in relation to the rotation of the outer rotor 17 will now be described, with the assumption that the camshaft 1 is not rotating.

The phase relationship of the outer rotor 17 to the inner rotor 16 is at an initial position, according to the first embodiment as illustrated in FIG. 4. When the outer rotor 17 is rotated in the clockwise direction X by 90 degrees, the slider 48 is shifted to a first operative position indicated by the solid line in FIG. 11(A). The slider 48 at the first operative position is slightly slid toward the point P2. Therefore, even though the outer rotor 17 is rotated with the timing pulley 10, the elongated opening 46 absorbs the radial movement of the timing pulley 10.

The outer rotor 17 is shifted by a small phase $\beta$ relative to the timing pulley 10. The relative movement of the pin 47 with respect to the slider 48 absorbs the phase shifting.

When the slider 48 is rotated by 180 degrees in the direction X, the slider 48 is moved in a second operative position indicated by the solid line in FIG. 11(B). As illustrated in FIG. 10, at the second operative position, the movement of the slider 48 reaches a maximum value, almost equal to twice the eccentric magnitude e.

According to the second embodiment, when the outer rotor 17 rotates around the center P2 of the camshaft 1, only the rotational movement is transmitted to the timing pulley 10 via the slider 48. The rotation around the center P2 is ignored by the slider 48 and the elongated opening 47. Therefore, the length of the timing belt 38 which connects the corresponding pulleys does not vary. As a result, the tension to the timing belt 38 does not vary significantly.

Unlike the first embodiment, the pulley 10 and the outer rotor 17 are separately formed. Therefore, the tolerance for the manufacture of the outer rotor 17 is significantly increased, and the manufacture tolerance for the entire trochoid gear mechanism is greatly improved. It would be desirable to select the most suitable materials for meeting various demands by each one of the trochoid gears and the timing pulley, in order to increase the functional ability of the control mechanism under various conditions.

Figure 12:
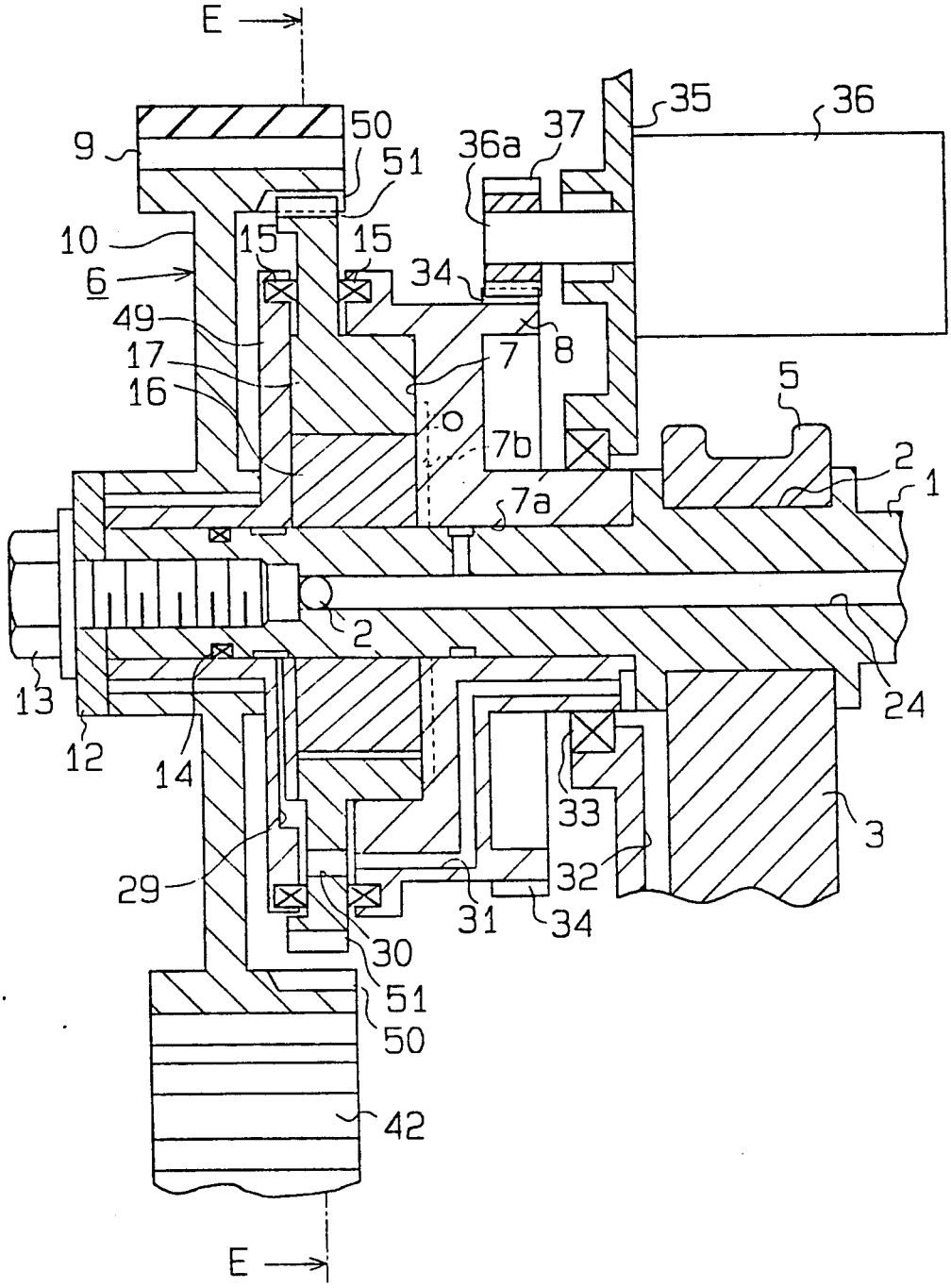
FIG. 12 is a cross-sectional view illustrating a valve timing mechanism of a third embodiment.
Figure 13:
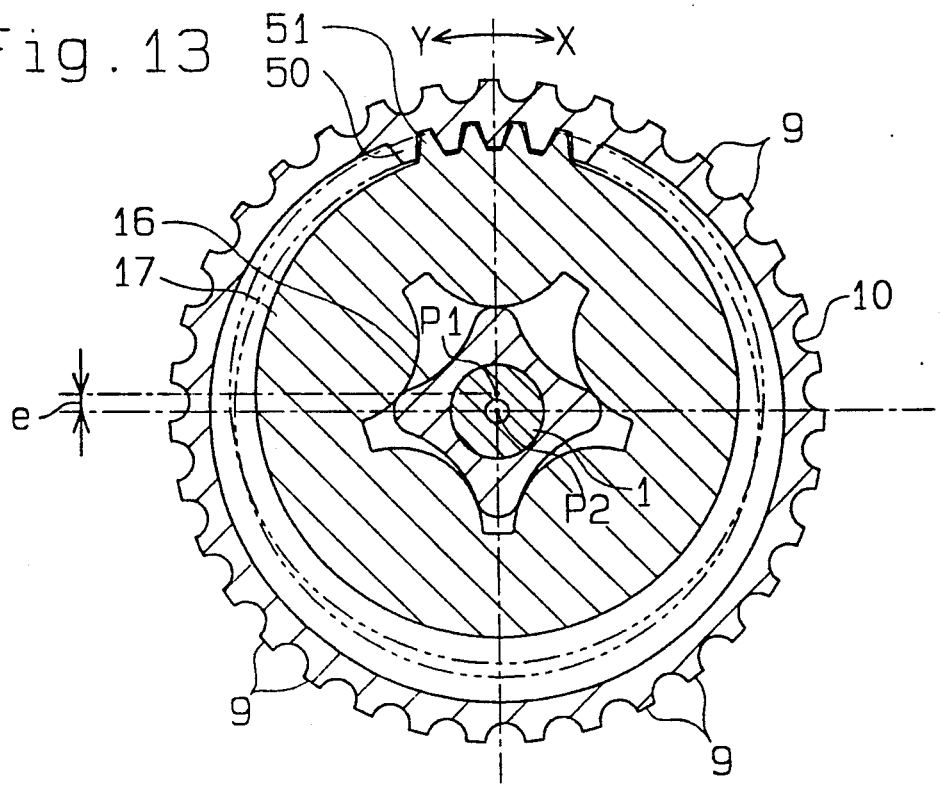
FIG. 13 is a cross-sectional view taken along a line E—E in FIG. 12.
Figure 14:
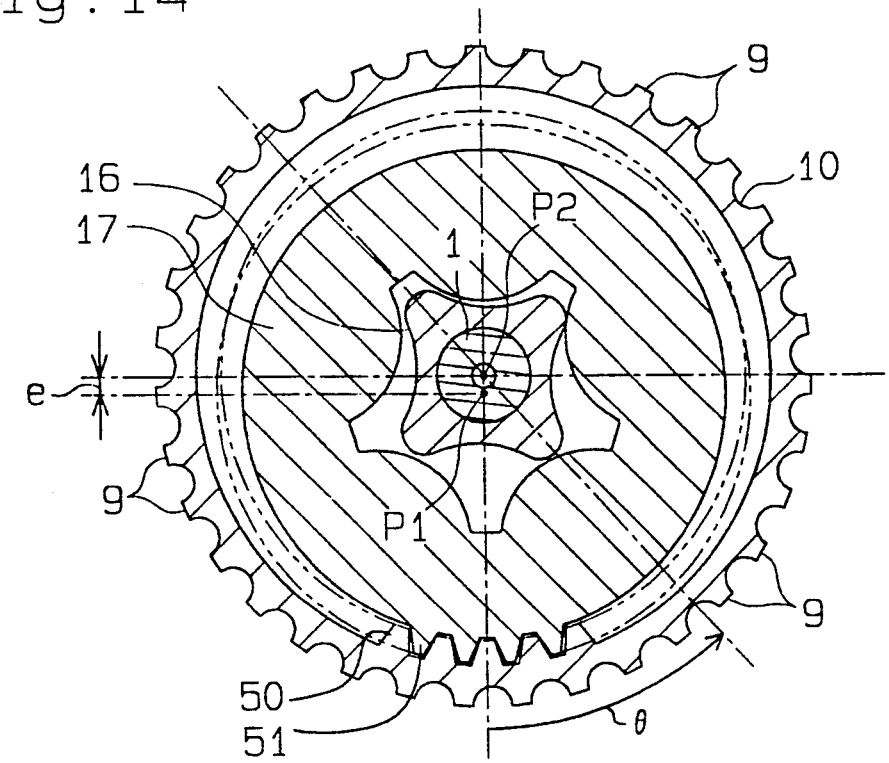
FIG. 14 is a cross-sectional view illustrating a trochoid gear engaging with an inner teeth gear of FIG. 13.
Figure 15:
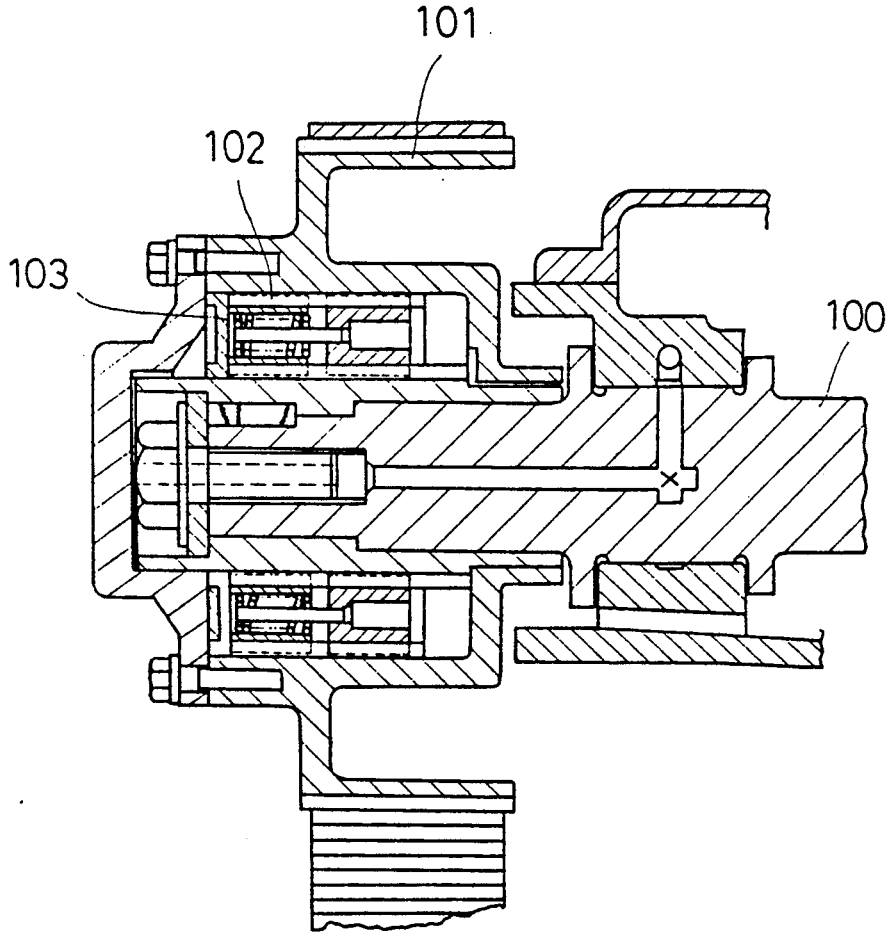
Fig. 15 (Prior Art)
FIG. 15 is a cross-sectional view of a prior art.

A third preferred embodiment according to the present invention will now be described referring to FIGS. 12 through 14.

According to the third embodiment, the outer rotor 17 and the timing pulley 10 are also separately formed. The cover 49 is disposed between the trochoid gear mechanism 18 and the timing pulley 10. A boss section of the timing pulley 10 is supported on the camshaft 1, via a boss section of the cover 49. The boss section of the timing pulley 10 is relatively rotatable. A plurality of gear teeth of an inner gear 50 are formed along the inner periphery of the timing pulley 10, and a plurality of gear teeth of a outer gear 51 are formed along the outer periphery of the inner rotor 17.

A circumference measured at the base portion of the gear teeth of the inner gear 50 is larger than that of the outer gear 51. Additionally, the number of the gear teeth of the gear 50 is larger than that of the outer gear 51. The center P1 and the center P2 are separated by an eccentric distance e.

The outer rotor 17 is rotated in an eccentric relationship with respect to the center P2 of the camshaft 1. FIG. 13 illustrates the engagement of the gear 50 and the gear 51. When the outer rotor 17 is rotated by about 180 degrees, the position of the rotor 17 changes.

Therefore, the movement of the outer rotor 17 is not transmitted to the timing pulley 10. Consequently, only the rotational transmission based on the gear engagement of the inner gear 50 and the outer gear 51 is transmitted. As a result, the tension to the timing belt 38 does not vary, as it does in the second embodiment. Consequently, the tensioner 43 does not absorb the length variation of the timing belt 38, and the durability of the tensioner 43 is optimized.

According to the third embodiment, the pulley 10 and the outer rotor 17 are separately formed. Therefore, similar to the second embodiment, the tolerance for the manufacture of the outer rotor 17 and the entire trochoid gear mechanism is significantly increased.

The inner and outer gears 49 and 50 along with the trochoid gear mechanism 18 act as a phase shifting mechanism for the rotational phase between the timing pulley 10 and the camshaft 1. The gear ratio of the crank pulley 42 to the timing pulley 10 is predetermined, in order to prevent the phase shifting of the crank shaft 41 with respect to the camshaft 1.

The present example and embodiment are to be considered as illustrative and not restrictive, and the invention is not to be limited to the details given herein, but may be modified within the scope of the appended claims.

What is claimed is:

1. A control mechanism for controlling the timing of at least one intake valve and at least one exhaust valve in an engine, the control mechanism comprising:

a camshaft for actuating said exhaust valves, the camshaft having a rotational center;

a timing pulley coupled to the engine and having a rotational center, whereby the rotational movement of the engine is transmitted to said timing pulley;

a first gear mechanism being driven by said timing pulley;

a second gear mechanism for engaging said first gear mechanism, and for generating a rotational phase shift of said timing pulley with respect to said camshaft;

a casing radially and rotatably mounted on the camshaft and concentric with the camshaft, wherein said first gear mechanism is disposed in the casing for integral rotation therewith; and drive means, operably connected to said casing, for rotating the casing to change said rotational phase shift;

wherein the rotational center of the timing pulley revolves around the rotational center of the camshaft when the drive means rotates the casing.

2. A control mechanism according to claim 1, wherein said first gear mechanism includes a trochoidally shaped outer rotor and said second gear mechanism includes a trochoidally shaped inner rotor.

3. A control mechanism according to claim 2, wherein said casing includes a recess which is eccentrically located with respect to said camshaft.

4. A control mechanism according to claim 3, wherein said drive means includes at least one sensor for detecting the operating condition of the engine and for generating sensing signals indicative thereof; and further including control means for sending control signals to said drive means, based on said sensing signals.

5. A control mechanism according to claim 1, wherein said first gear mechanism is integrally formed with said timing pulley.

6. A control mechanism according to claim 1, wherein said first gear mechanism and said timing pulley are separately formed, and are connected so as to rotate in a unitary way; and further including means for permitting said rotational phase shift changes to occur based on the relative position of said first and second gear mechanisms.

7. A control mechanism according to claim 6, wherein said permitting means includes an elongated radial opening formed in said timing pulley for receiving a slider therein; and wherein said slider extends from said first gear mechanism.

8. A control mechanism according to claim 6, wherein said permitting means includes a first set of peripheral teeth formed on said timing pulley, and a second set of peripheral teeth formed on said first gear mechanism;

wherein said first and second sets of teeth engage each other;

wherein said first set of teeth are generally disposed on the perimeter of a circle having a first radius;

wherein said second set of teeth are generally disposed on the perimeter of a circle having a second radius; and wherein said first radius is larger than said second radius.

9. A control mechanism for controlling timing of a plurality of intake and exhaust valves in an engine, comprising:

a camshaft for actuating said exhaust valves, said camshaft having a rotational center;

a timing pulley coupled to the engine and having a rotational center, whereby the rotational movement of the engine is transmitted to said timing pulley;

a first gear mechanism being driven by said timing pulley;

a second gear mechanism for engaging said first gear mechanism, and for generating a rotational phase shift of said timing pulley with respect to said camshaft;

a casing radially and rotatably mounted on the camshaft and concentric with the camshaft, wherein said first gear mechanism is disposed in the casing for integral rotation therewith;

drive means, operably connected to said casing, for rotating the casing to change said rotational phase shift, wherein the rotational center of the timing pulley revolves around the rotational center of the camshaft when the drive means rotates the casing; and means for permitting said rotational phase shift change to occur based on the relative position of said first and second gear mechanisms.

10. A control mechanism according to claim 9, wherein said first gear mechanism includes a trochoidally shaped outer rotor;

wherein said second gear mechanism includes a trochoidally shaped inner rotor; and wherein said inner and outer rotors form a trochoid pump for supplying lubricating oil to said camshaft.

11. A control mechanism according to claim 10, wherein said casing includes a recess which is eccentrically located with respect to said camshaft.

12. A control mechanism according to claim 11, wherein said drive means includes at least one sensor for detecting the operating condition of the engine and for generating sensing signals indicative thereof; and further including control means for sending control signals to said drive means, based on said sensing signals.

13. A control mechanism according to claim 9, wherein said permitting means includes an elongated radial opening formed in said timing pulley for receiving a slider therein; and wherein said slider extends from said first gear mechanism.

14. A control mechanism according to claim 9, wherein said permitting means includes a first set of peripheral teeth formed on said timing pulley; and a second set of peripheral teeth formed on said first gear mechanism;

wherein said first and second sets of teeth engage each other;

wherein said first set of teeth are generally disposed on the perimeter of a circle having a first radius;

wherein said second set of teeth are generally disposed on the perimeter of a circle having a second radius; and wherein said first radius is larger than said second radius.

15. A control mechanism for controlling the timing of a plurality of intake and exhaust valves in an engine comprising:

a camshaft for actuating said exhaust valves;

a timing pulley coupled to the engine, the rotational movement of the engine being transmitted to said pulley;

a trochoidally shaped outer rotor being driven by said timing pulley and having a set of trochoid gear teeth;

an inner rotor having a set of outwardly protruding trochoid gear teeth being engaged with said set of trochoid teeth of said outer rotor, said inner and outer rotors forming a trochoid pump for supplying lubricating oil to said camshaft;

the number of said gear teeth of said outer rotor being greater than that of said gear teeth of said inner rotor;

said trochoid pump generating a rotational phase shift of said timing pulley with respect to said camshaft;

drive means including at least one sensor for detecting the operating condition of the engine and for generating sensing signals indicative thereof;

control means for sending control signals to said drive means, based on said sensing signals; and means for permitting rotational phase shift changes to occur based on the relative position of said first and second gear mechanisms.

16. A control mechanism according to claim 15, wherein said permitting means includes an elongated radial opening formed in said timing pulley for receiving a slider therein; and wherein said slider extends from said first gear mechanism.

17. A control mechanism according to claim 15, wherein said permitting means includes a first set of peripheral teeth formed on said timing pulley; and a second set of peripheral teeth formed on said first gear mechanism;

wherein said first and second sets of teeth engage each other;

wherein said first set of teeth are generally disposed on the perimeter of a circle having a first radius;

wherein said second set of teeth are generally disposed on the perimeter of a circle having a second radius; and wherein said first radius is larger than said second radius.

18. A control mechanism according to claim 15, further comprising:

a casing radially and rotatably mounted on the camshaft and the concentric with the camshaft, wherein the outer rotor is disposed in the casing for integral rotation therewith; and drive means, operably connected to the casing, for rotating the casing, wherein a rotational center of the timing pulley revolves around a rotational center of the camshaft when the drive means rotates the casing.

* * * * *